United States Patent [19]

Spitz et al.

[11] 4,162,654

[45] Jul. 31, 1979

[54] POLLUTION CONTROLLED INCINERATION SYSTEM

[75] Inventors: Albert W. Spitz, Wyncote; Milton I. Schwab, Philadelphia, both of Pa.

[73] Assignee: Trio Process Corporation, Wyncote, Pa.

[21] Appl. No.: 806,831

[22] Filed: Jun. 15, 1977

[51] Int. Cl.[2] ..... F23G 5/12; F23J 15/00

[52] U.S. Cl. ..... 110/212; 110/215; 110/241; 110/346

[58] Field of Search ..... 110/8 R, 8 A, 18 R, 110/19, 20, 21, 72 R, 84, 119

[56] References Cited

U.S. PATENT DOCUMENTS

| | | | |
|---|---|---|---|
| 1,729,572 | 9/1929 | Evans | 110/8 |
| 1,795,771 | 3/1931 | Golovtchikoff | 110/8 |
| 3,076,421 | 2/1963 | Spitz | 110/18 |
| 3,344,758 | 10/1967 | Wotschke | 110/18 |
| 3,610,180 | 10/1971 | Scott et al. | 110/18 |
| 3,664,278 | 5/1972 | Steen | 110/72 |
| 3,745,939 | 7/1973 | Allbritton | 110/119 |
| 3,861,333 | 1/1975 | Krumm | 110/8 |
| 3,862,609 | 1/1975 | Eff | 110/119 |
| 3,889,608 | 6/1975 | Pitt | 110/8 |

*Primary Examiner*—Kenneth W. Sprague

*Attorney, Agent, or Firm*—Weiser, Stapler & Spivak

[57] ABSTRACT

A pollution control incineration system comprises an elongated duct having one or more inlets positioned at or near grade level. An upright standpipe removably covers an inlet opening to provide a polluted gas inlet to the duct from a location elevated above grade. The duct terminates at its remote end in a combination flue and pollution control system which may include pollution control devices such as an afterburner chamber, a water spray cooling chamber, a baghouse and an induced draft fan. A portable, shell type primary combustion chamber removably overfits the standpipe to allow combustible material to be burned within the shell and to direct the gases of combustion downwardly into the duct through the top of the standpipe.

15 Claims, 3 Drawing Figures

POLLUTION CONTROLLED INCINERATION SYSTEM

BACKGROUND OF THE INVENTION

The present invention relates generally to incinerators, and more particularly is directed to an incineration system including one or more portable incinerators in combination with non-portable air pollution control equipment especially suited for the recovery of valuable metals, copper, etc. from electrical and other scrap material.

It is now usual practice in most political subdivisions to require the installation of suitable mechanical equipment for control of air pollutants resulting from the incineration of combustible solids and liquid. Air pollution control equipment of known types have included afterburners, settling chambers, scrubbers, electrostatic cleaners, spray chambers, baghouses and the like. A wide variety of more or less sophisticated or specialized equipment has been developed by prior workers in the art and such equipment is presently available to clean the effluent air from numerous polluting activities such as various industrial processes and incineration. In the case of permanent installations that are permanently fixed in location, pollution control equipment and systems can be designed and installed in accordance with known practice to provide satisfactory operating installations of suitable effectiveness and efficiency to comply with the requirements of known standards such as air pollution control ordinances promulgated and approved by numerous municipalities and states, and the federal government.

Problems have arisen in certain situations where, due to the nature and composition of the material to be burned, such materials cannot be conveniently placed within fixed incineration equipment. Combustibles such as the insulation covering scrap wire and the fibrous materials of printed circuit boards pose a unique incineration problem because of material handling difficulties. Such scrap wire normally is cumbersome, unwieldly and generally uneconomical to transport to a fixed incinerator. It is necessary and desirable, however, to remove the combustible insulation from the wire to reclaim the wire. One solution to such a problem has been described in detail in Spitz U.S. Pat. No. 3,076,421 which patent is assigned to the assignee of the present application. In U.S. Pat. No. 3,076,421, a novel process for handling scrap wire has been disclosed wherein a portable, conical, shell type incinerator was moved by crane over a pile of scrap wire for incineration purposes rather than the more conventional method of transporting the combustible material to a fixed incineration plant.

An afterburner for pollution control was provided as an integral part of the portable incinerator, supplied with fuel gas through a flexible tube. This contributed a substantial amount of weight to the unit and also added to its overall height. This present invention with a separate, fixed afterburner, allows a wide choice of pollution control and heat recovery processes and equipment. The present invention also considerably reduces the height and weight of the portable primary combustion chamber. Additionally, it eliminates the need for flexible fuel connections and permits the use of any fuel, gas, oil or even pulverized coal in the afterburner. With a waste heat boiler or other device, heat from the afterburner, which is wasted in the process of U.S. Pat. No. 3,076,421, can be reclaimed. The portable part of the system, the primary combustion chamber, which receives the greatest wear, is considerably simplified, and is economical to repair or replace.

SUMMARY OF THE INVENTION

The present invention relates generally to the field of air pollution control equipment and more particularly is directed to an apparatus and method for the recovery of valuable metals and copper from electrical and other scrap materials.

The present invention seeks to overcome the difficulties experienced by prior workers in the art when attempting to utilize satisfactory air pollution control measures to control the effluent from portable incinerators. In accordance with the teachings of the present invention, portable incinerators are employed in conjunction with a pollution control system wherein the air pollution control equipment has been designed and arranged in a permanent manner. The air pollution control equipment is connected to duct work, which may be positioned below grade. A plurality of incinerator inlets are provided in the duct to accommodate one or more portable primary combustion chambers or incinerators. The incinerators are designed for movement to the inlets to thereby direct polluted gases through the inlets and into the air pollution control system.

In a preferred embodiment, an underground duct system is permanently installed and at the inlet end, the duct system includes one or more inlets in spaced locations. A portable primary combustion chamber or incinerator is provided for each inlet to be used. The remote end of the underground duct terminates in the fixed air pollution control equipment for cleaning the effluent gases from the incinerators prior to exhaust to atmosphere.

Each underground duct inlet opening is provided with a vertical, hollow standpipe which has its interior conduit or channel in communication with the inlet whereby the standpipe serves to elevate the effective inlet opening to a location that is spaced above the ground. Thus, gases of combustion from within the portable incinerator must first travel downwardly through the standpipe prior to entrance into the underground duct system. In practice, the standpipe preferably may be fabricated of self-standing construction, without permanent interconnection to the duct system, to prevent damage when in use.

In order to use the pollution controlled incineration system of the present invention, the combustible material such as scrap wire, printed circuit boards or other material to be burned or processed is piled about the standpipe by utilizing conventional equipment such as bulldozers, cranes, etc. After moving the materials to the standpipe location, a portable incinerator of the type that is fabricated to an inverted, conical configuration is applied over the material and over the standpipe. The peripheral junction between the bottom edge of the incinerator shell and the ground can be covered with dirt or other materials to provide a peripheral seam that is substantially air tight. Small adjustable doors are provided around the base of the primary combustion chamber so that the amount of combustion air entering can be controlled. As set forth in Spitz U.S. Pat. No. 3,076,421, the amount of combustion air should be sufficient to support combustion at a relatively slow rate. In this manner, combustion temperatures are minimized as the wire insulation or other combustible material is burned, and, in the case of copper wire, oxidation of the copper during incineration is also minimized.

It is noteworthy that the present system provides a portable primary combustion chamber having no flue connection and no air pollution control equipment directly associated therewith.

The underground duct receives gases of combustion and partially oxidized organic vapors from within the primary combustion chamber through the standpipe and the duct inlet. The duct directs the gases and vapors to a permanent pollution control system. The pollution control system includes an afterburner chamber wherein the effluent from the primary combustion chamber is completely oxidized and wherein a portion of the required heat is supplied. Exhaust gases from the underground duct enter the bottom of the afterburner of the pollution control system and travel upwardly therethrough. The afterburner chamber includes one or more burners and a restrictive orifice to initiate the air cleaning process. The partially cleaned gases travel from the afterburner chamber across a horizontal stack section and thence downwardly through the cooling chamber. The cooling chamber serves as a water spray cooling chamber and may be equipped with a water spray cooling system for air cleaning and gas cooling purposes. Exhaust from the cooling chamber, if sufficiently cleaned of pollutants within the afterburner chamber and cooling chamber can be exhausted to atmosphere. If the effluent gases are still below code standards for atmospheric discharge after traveling through the water spray cooling chamber, a baghouse can be installed in the system in well known manner. in the event the material being incinerated produces chlorides, it is desirable to employ a pre-coated baghouse of known design. A waste heat reclamation unit may be incorporated into the top of the afterburner or in the duct leading to the cooling chamber. An induced draft fan is positioned at the end of the pollution control system and acts to provide a positive induced draft throughout in accordance with known practice.

It is therefore an object of the present invention to provide an improved, pollution controlled incineration system of the type set forth.

It is another object of the present invention to provide a novel pollution controlled incineration system comprising a portable incinerator or primary combustion chamber and means to conduct exhaust gases from the incinerator to a fixed pollution control system.

It is another object of the present invention to provide a pollution controlled incineration system comprising a portable, conical, inverted incinerator shell and means to exhaust gases from the shell without utilizing an incinerator stack.

It is another object of the present invention to provide a novel pollution controlled incineration system comprising an underground duct system, one or more standpipe equipped inlets to the system and a single, remote duct exhaust comprising permanently installed, pollution control apparatus.

It is another object of the present invention to provide a novel pollution controlled incineration system comprising an underground duct system, a standpipe inlet which spaces an inlet to the duct above ground level, a portable incinerator removably located over the standpipe and permanently installed pollution control apparatus receiving exhaust gases from within the portable incinerator through the standpipe inlet.

It is another object of the present invention to provide a novel pollution controlled incineration system comprising duct means, standpipe means communication with the duct means, portable incinerating means overfitting the standpipe means and pollution control means receiving exhaust gases from the incinerator means through the standpipe means and the duct means.

It is another object of the present invention to provide a method of controlling polluted air comprising the steps of incinerating scrap material within a portable incinerator and creating gaseous pollutants, directing the pollutants downwardly through a standpipe into a duct system, leading the pollutants through the duct system to a pollution control apparatus, directing the polluted gases upwardly and downwardly through the pollution control apparatus, cleaning the polluted gases within the pollution control apparatus and then exhausting the effluent in clean condition.

It is another object of the present invention to provide a novel pollution controlled incineration system that is partly portable and partly fixed in construction, simple in design and trouble-free when in operation.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENTS OF THE INVENTION

Figure 1:
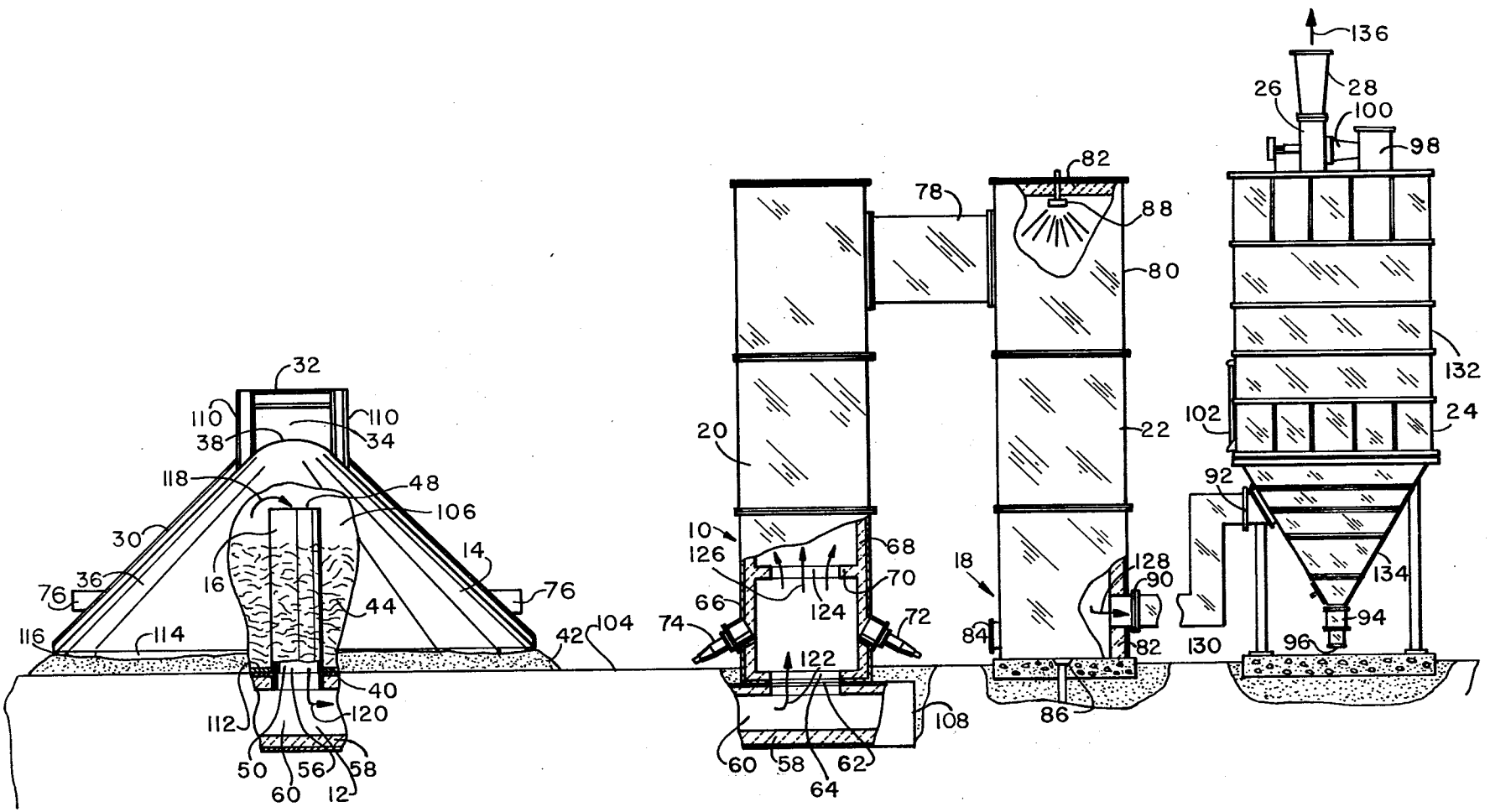
FIG. 1 is a schematic elevational view showing the general arrangement of the operating elements of the invention, with portions thereof partly broken away to expose details of interior construction.

Although specific terms are used in the following description for the sake of clarity, these terms are intended to refer only to the particular structure of the invention selected for illustration in the drawings and are not intended to define or limit the scope of the invention.

Referring now to the drawings, there is shown in FIG. 1 a pollution controlled incineration system generally designated as 10 which comprises in part a duct system 12 suitable to remove pollution laden gases of combustion from the incinerator or primary combustion chamber 14 in the manner hereinafter more fully set forth. In the preferred embodiment, the duct system 12 is positioned below ground level 104 to prevent damage, facilitate use and to minimize space requirements.

As illustrated, the duct system 12 is positioned below grade level 104 in a manner not to interfere with the normal operation of an incinerator plant wherein mechanical equipment (not shown) such as bulldozers, can be utilized to position and pile the loose material 44 to be burned, for example, insulation covered wire, against the outer periphery of the standpipe 16. Of course, the construction of the underground duct 12 should be designed of sufficient strength in well known manner to withstand the weight of the mechanical equipment that may be imposed thereon. The duct system 12 is fabricated to define an interior, elongated, continuous channel 60 of sufficient cross-sectional size to conduct the gaseous pollutants (not illustrated) which are generated by the combustion of the waste materials 44 from the portable incinerator or primary combustion chamber 14 to the pollution control system 18.

Inasmuch as these materials 44 will be incinerated within the interior space 106 enclosed by the portable incinerator shell 36, the pollutant laden gases will be elevated in temperature by the combustion process. To prevent deterioration of the duct system 12 as a result of high gas temperatures, in the preferred embodiment, the duct system is lined with a refractory material 58 of known composition suitable to withstand the effects of elevated temperatures and gases of combustion. The duct 12 comprises one or more gas inlet openings 56 whereby one or more portable incinerators 14 can be accommodated at the same time to direct the gaseous effluent from the incinerators to the pollution control system 18. The duct system 12 terminates in a remote end 108 which includes a single outlet 62 through which pollutant laden gases from the incinerators 14 exit from the underground duct 12 to enter the pollution control system 18 prior to exhaust to atmosphere through the exhaust duct 28.

Figure 2:
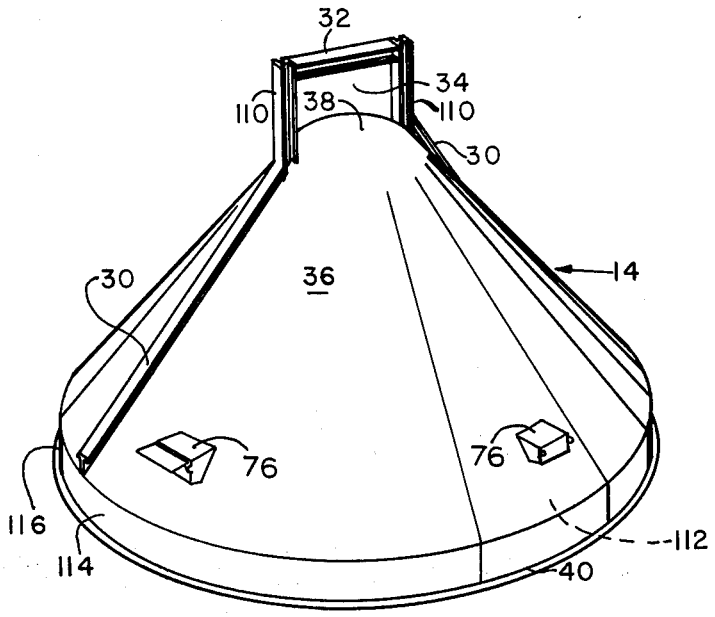
FIG. 2 is an enlarged, perspective view of a portable incinerator constructed in accordance with the teachings of the present invention.

As illustrated in FIGS. 1 and 2, the portable combustion chamber 14 is fabricated of plate steel to an inverted, hollow, conical configuration which terminates upwardly in a closed apex or top 38 and which terminates downwardly in an open circular base which is defined by the bottom periphery 40 of the incinerator shell 36. A structural frame 30 is welded or otherwise fixed to portions of the conical shell 36 in well known manner to provide structural integrity and also to prevent distortion when the incinerator 14 is used or transported. The members comprising the incinerator frame 30 converge upwardly and are welded or otherwise affixed to the upright supports 110 in a sturdy manner. The supports 110 upwardly carry a transverse web 32 which furnishes a convenient place of attachment for the hook or cable or clamshell bucket of a crane (not shown) for primary chamber transport. The crane can also be used to pile material around the standpipe 16 and to unload the residual material after incineration is complete. The upper supports 110 and the transverse web 32 define a space 34 between the structural members and the incinerator shell 36 which provides sufficient clearance whereby the hook, clamshell bucket or other suitable member may be inserted when grasping the web or yoke 32 for primary combustion chamber transport purposes. In use, a crane or similar device (not shown) can be utilized to lift and transport the portable incinerator 14 by engaging the incinerator at the upper web 32 thereof during the lifting and transporting operations in well known manner. If desired, the primary combustion chamber shell 36 may be changed from conical to cylindrical near the bottom thereof to form a generally cylindrical section 114 comprising a short, vertical side wall 116 immediately above the shell bottom periphery 40. In practice, a 6 inch by 6 inch angle formed to a circular configuration may be used to form the bottom of the conical, portable shell, thereby reinforcing it structurally. In use, dirt 42 or similar loose material may be piled against the vertical side wall 116 to limit the amount of combustion air that can enter the interior 106 of the conical incinerator shell 36 through the junction between the bottom periphery 40 of the shell and the ground 104, thereby limiting the rate of combustion and the internal temperatures generated during the combustion process. If necessary or desirable for operating efficiency, one or more combustion air openings 76 can be provided in the shell 36 to allow additional air for combustion purposes to enter the interior 106 of the portable incinerator 14. Initial ignition can also be accomplished through an opening 76. In the preferred embodiment, the shell 36 is unlined, whereby some of the heat of combustion can radiate and escape directly through the shell. This construction also aids in reducing internal temperatures within the incinerator during combustion. However, for some uses, it may be desirable to use lightweight insulation on the inside of the shell.

As above set forth, the duct system 12 may include a plurality of inlet opeings 56 which are spaced apart a distance greater than the diameter of an incinerator bottom whereby a single, permanently installed pollution control system 18 may be utilized to treat the effluent from a plurality of portable primary combustion chambers 14. The duct system 12 may include inlets located in one or more branches which feed the single duct outlet, 62, or may include a plurality of inlets spaced along a unitary branch. Each branch comprises one or more inlet openings 56, each opening being equipped with a standpipe 16 for initial control of pollutant laden gases. Each standpipe extends in height a suitable distance to provide for flow of gases resulting from combustion within the incinerator downwardly therethrough. A standpipe height of approximately six to eight feet has been found generally suitable for this purpose.

Figure 3:
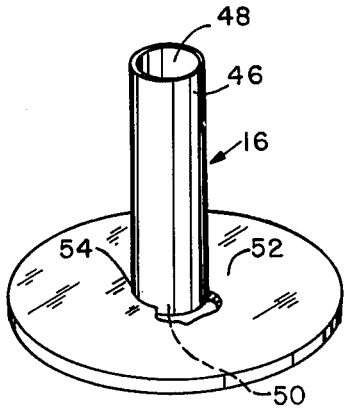
FIG. 3 is an enlarged, perspective view showing one embodiment of a standpipe construction.

As best seen in FIG. 3, each standpipe 16 is fabricated to a hollow, cylindrical configuration and preferably is fabricated of cast heat resistant alloy which is formed to the desired configuration in manner well known to those skilled in the art. A standpipe diameter of between one to three feet has generally been found satisfactory for the purpose. The standpipe bottom may be affixed directly to the duct inlet opening 56 in a substantially leak-free junction to assure that the gases will enter the duct system 12 through the standpipe upper end or inlet 48 and then flow downwardly therethrough to the standpipe outlet 50 which is in communication with the underground duct inlet 56.

In use, the material to be burned, such as insulation covered wire 44 or other combustible material is piled or otherwise positioned about the outer periphery of the standpipe 16 in well known manner such as by employing a bulldozer. After the material to be burned is piled about the outer periphery of the standpipe 16, a crane or other device then transports and lowers the portable incinerator 14 directly over the standpipe 16 and the piled material 44. After the incinerator has been thus positioned, dirt 42 is placed about the bottom periphery of the incinerator to limit the amount of air that can enter the interior 106 of the portable incinerator 14.

To prevent damage to the system which may be occasioned by the bulldozer or other equipment (not shown) striking the standpipe 16 and also to permit the easy removal of standpipes 16 from areas or branches of the duct system 12 that are not in use, in a preferred embodiment as illustrated in FIG. 3, the standpipe 16 may also be fabricated to be generally portable in nature. In the embodiment illustrated in FIG. 3, the exhaust tube 46 of the standpipe 16 terminates downwardly in a relatively heavy supporting base 52 which preferably is also fabricated of heat resisting alloy and which may extend in diameter a length of approximately seven feet to provide sufficient stability. The exhaust tube 46 can be secured to the support 52 in a well known manner such as by employing a peripherally welded junction 54 and the supporting base is provided with an opening therethrough equal to the standpipe interior diameter. By utilizing the support 52 which is relatively heavy because of its diameter and thickness, most lateral forces directed against the exhaust tube 46 will be resisted by the weight of the base 52. However, should the lateral forces directed against the exhaust tube 46 be unusually great, such as when accidentally struck by a bulldozer, then because of the unitary, portable construction, the entire standpipe 16 comprising the exhaust tube 46 and the support base 52 will be moved from the resting place above the duct opening 56 without damage to any of the parts. In this manner, such lateral forces can be dissipated in movement and in friction without damage. In the event of such a happening, prior to utilizing the incinerator 14, the standpipe bottom opening 50 should be re-registered over the duct opening 56 to assure unrestricted flow of pollutant laden gases into the duct system 12. If desired, the duct openings 56 may be equipped with steel bars or grills both as a safety precaution and also to prevent the entrance of large foreign materials into the underground duct system 12.

Referring now to FIG. 1, a single air pollution control system 18 is illustrated to receive pollutant laden gases from the interior 106 of one or more portable incinerators 14. Gases of combustion from within the incinerators travel downwardly through the standpipe 16, through the underground duct inlet opening 56, horizontally through the duct 12 and then upwardly through the single duct outlet opening 62 into the interior of the control system afterburner chamber 20 in a path indicated generally by the arrows 118, 120 and 122.

The afterburner 20 of the pollution control system 18 comprises a vertical, tubular structure through which the pollutant gases upwardly flow. Preferably, the interior of the afterburner chamber 20 is refractory lined to prevent damage from the hot gases resulting from combustion within the interior of the portable incinerators 14. As illustrated, the refractory lining 68 interiorly covers and protects the afterburner chamber steel shell 66. A turbulence ring 70 projects radially inwardly and may be integrally formed of refractory lining material. As illustrated, the ring 70 defines a constricted orifice 124 through which the gases of combustion upwardly flow as indicated by the arrows 126. The turbulence ring 70 serves to restrict the flow of gases through the orifice 124 to increase turbulence and to assure a better mixing of gases as the combustion gases travel through the afterburner 20. Two or more burners are angularly positioned near the bottom of the afterburner chamber 20 to aid in the air pollution control function of the system 18. The burners 72, 74 may be oil fired or gas fired of well known design for the purpose, such as the duel fuel burners manufactured and sold by the North American Manufacturing Co., Cleveland, Ohio.

The choke ring or turbulence ring 70 acts to prevent stratification of burner gases and combustion gases when traveling upwardly in the afterburner 20. The orifice 124 mixes the burner gases and combustion gases by creating turbulence at the ring 70 to enhance combustion within the afterburner chamber 20. The upper section of the afterburner chamber 20 may have a waste heat reclaimer not shown incorporated into its design whereby a substantial amount of heat from both the burning of the insulation and other materials and from the afterburner chamber fuel can be recovered. It is anticipated that once the afterburner becomes sufficiently hot, the process will be self-sustaining and will require no additional fuel.

The chamber 22 is preferably fabricated similarly to the afterburner chamber 20 and includes an outer steel shell 80 which is interiorly peripherally protected by a full refractory lining 82 in known manner. The chamber 22 is designed as a water spray cooling chamber and is upwardly equipped with a spray nozzle 88 which feeds a liquid spray interiorly for gas cooling purposes and for removal of large particulate matter. The interior of the chamber 22 includes a bottom positioned drain 86 to drain excess liquid and entrained particles therethrough to a suitable disposal (not shown). If desired, a clean-out 84 may be positioned near the bottom of the chamber 22 in conventional manner to permit entry into the interior of the steel shell 80 for inspection, interior cleaning purposes, etc. The cooled gases flow downwardly through the chamber 22 and through the spray chamber outlet 90 as indicated by the arrow 128. The cooled and partially cleaned gases flow through the outlet 90, through the transition duct 130 and into the inlet 92 of a baghouse system 24 for further cleaning, if necessary.

The baghouse 24 is conventional in design and comprises a usual enclosing shell 132 which terminates downwardly in a receiving hopper 134 wherein particulate, solid matter is directed. The baghouse 24 conventionally includes a hinged access door 102 and a usual screw conveyor 94 including an air lock or control valve 96.

The combination of the burners 72, 74 positioned within the afterburner chamber 20, the action of the spray nozzle 88 within the spray chamber 22 and the equipment contained within the baghouse 24 serve to adequately clean the polluted gases generated in the combustion process within the interior of the portable incinerator 14 to meet all presently known air pollution control standards. The pollution control system 18 is fixed in construction and employs all necessary equipment and controls required to clean the pollutants from the combustion gases prior to discharge to atmosphere. Accordingly, even though one or more portable incinerators 14 are employed in the process and the portable incinerators do not themselves incorporate pollution control apparatus, the fixed pollution control system 18 fully treats all of the gases of combustion to adequately clean the polluted effluent from the incinerators.

The cleaned gases (not shown) upwardly exit from the top of the baghouse 24 through a conventional poppet 98 and flow through the transition duct 100 to the inlet of the fan 26, which is motor driven in conventional manner. The cleaned air is then discharged to atmosphere through the exhaust duct 28 as indicated by the arrow 136. The fan or fans 26 serve as an induced draft fan apparatus to positively pull the gases of combustion from the within the incinerators 14 and through the system 10 in the direction indicated by the arrows 118, 120, 122, 126, 128 and 136. If desired to aid in the gas cleaning process, the baghouse may be precoated in known manner to remove chlorides and other pollutants normally resulting from the combustion of certain plastics such as polyvinylchloride.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. In a pollution controlled incinerator system to clean gases of combustion produced within an incinerator, the combination of a non-movable duct system having at least one inlet opening and an outlet opening;

a standpipe means positioned over the inlet opening to raise the effective height of the inlet opening above the duct system;

separate, flue-loss, portable incinerator means overfitting the duct inlet opening and the standpipe means, said incinerator means being adapted to direct gases of combustion through the inlet opening; and non-movable pollution control system means receiving the gases of combustion from the duct system outlet opening;

said pollution control system means comprising means to clean at least some of the gases of combustion.

2. The pollution controlled incinerator system of claim 1 wherein the portable incinerator means comprises a shell having an open bottom and a closed top, and wherein the portable incinerator means is self supporting by resting the bottom upon ground.

3. The pullution controlled incinerator system of claim 2 wherein the shell comprises means to prevent escape of gases of combustion through the shell wall.

4. The pollution controlled incinerator system of claim 3 and induced draft fan means positioned downstream of the pollution control system means to induce the flow of combustion gases from within the incinerator means through the duct system.

5. The pollution controlled incinerator system of claim 1 wherein the standpipe means is adapted to be movably positioned over the said inlet opening.

6. The pollution controlled incinerator system of claim 5 wherein the standpipe means comprises a movable, hollow cylindrical exhaust tube and a movable supporting base affixed to the bottom of the exhaust tube in a substantially leakproof junction.

7. The pollution controlled incinerator system of claim 4 wherein the pollution control system means comprises an inlet afterburner chamber through which the gases of combustion enter through the said duct system outlet opening, said afterburner chamber comprising an afterburner, said afterburner producing heated burner gases to aid in pollution control.

8. The pollution controlled incinerator system of claim 7 wherein the the afterburner chamber further comprises a turbulence ring to mix the burner gases with the gases of combustion.

9. The pollution controlled incinerator system of claim 7 wherein the pollution control system further comprises an outlet leg equipped with a spray nozzle to direct a liquid spray through the gases as the mixture of afterburner burner gases and the incinerator gases of combustion are induced through the outlet leg.

10. The pollution controlled incinerator system of claim 9 wherein the pollution control system means further comprises a baghouse through which the gases of combustion are directed for pollution control purposes.

11. The pollution controlled incinerator system of claim 10 wherein the baghouse is interiorly precoated.

12. The method of controlling polluted air resulting from waste incinerator comprising the steps of piling waste material about a hollow standpipe and covering the waste material and standpipe with a portable incinerator;

incinerating the waste material within the portable incinerator and creating gases of combustion;

directing the gases downwardly through the standpipe from within the incinerator into the inlet opening of a duct system;

inducing the gases through the duct system to a duct system outlet;

directing the gases upwardly through the outlet into a pollution control apparatus;

cleaning the gases within the apparatus; and discharging the cleaned gases to atmosphere.

13. The method of claim 12 and the additional step of heating the gases within the apparatus.

14. The method of claim 13 wherein the heating includes creating turbulence and mixing the gases.

15. The method of claim 14 and the additional step of cooling the gases in the apparatus.

* * * * *